US005427646A

United States Patent [19]

Trygg

[11] Patent Number: 5,427,646

[45] Date of Patent: Jun. 27, 1995

[54] GLUING PALETTE AND A GLUE-TRANSFER PART FOR USE THEREWITH

[76] Inventor: Lars E. Trygg, Box 243, S-372 24 Karlshamn, Sweden

[21] Appl. No.: 211,503

[22] PCT Filed: Oct. 13, 1992

[86] PCT No.: PCT/SE92/00719

§ 371 Date: Apr. 6, 1994

§ 102(e) Date: Apr. 6, 1994

[87] PCT Pub. No.: WO93/08083

PCT Pub. Date: Apr. 29, 1993

[30] Foreign Application Priority Data

Oct. 17, 1991 [SE] Sweden ..... 9103027

[51] Int. Cl.[6] ..... B65C 9/10

[52] U.S. Cl. ..... 156/566; 156/571; 156/581; 156/582

[58] Field of Search ..... 492/28, 30, 45, 48, 492/56; 156/582, 583.3, 581, 566, 571

[56] References Cited

U.S. PATENT DOCUMENTS

| | | | |
|---|---|---|---|
| 1,837,084 | 12/1931 | Vanatta | 492/30 |
| 2,694,874 | 11/1954 | Coolidge et al. | 492/56 X |
| 3,030,915 | 4/1962 | Shannon | 118/212 |
| 3,865,671 | 2/1975 | Kronsder | 156/488 |

FOREIGN PATENT DOCUMENTS

| | | | |
|---|---|---|---|
| 4714007 | 4/1972 | Japan | 492/45 |
| 239079 | 2/1990 | Japan | 492/56 |
| 760628 | 11/1956 | United Kingdom . | |
| 776206 | 6/1957 | United Kingdom | 118/212 |

*Primary Examiner*—David A. Simmons
*Assistant Examiner*—Steven J. Helmer
*Attorney, Agent, or Firm*—Sughrue, Mion, Zinn, Macpeak and Seas

[57] ABSTRACT

A gluing palette for use with apparatus for gluing labels to objects, such as bottles or the like. The palette is intended to coact with a rotary gluing roller so as to be coated with glue and then to transfer glue to a label transported by the palette from a label magazine to a transfer device. The transfer device is intended to take the glue-coated label from the palette and press the label against the object concerned. The palette includes a core (18) and a carrier which is fitted to the core and can be readily detached therefrom. The carrier has the form of an elastic, pliable apron element (21) which will mould itself to the configuration of the core (18) and which is provided with at least one outwardly projecting part (23) made of an elastic material. This outwardly projecting part has a shape which corresponds essentially to the shape of the label to be coated with glue. Projections (22) on the apron element cooperate with recesses (20) on the core to fix the apron element in position and to prevent any lateral stretching of a portion of the apron element relative to the core.

10 Claims, 2 Drawing Sheets

GLUING PALETTE AND A GLUE-TRANSFER PART FOR USE THEREWITH

BACKGROUND OF THE INVENTION

The present invention relates to a gluing palette for use with machines in an arrangement intended for gluing labels to objects, such as bottles or the like, said palette being intended to coact with a rotating gluing roller such as to be coated with glue and thereafter to transfer glue to a label which is transported by the palette from a label magazine to a label transfer means which is intended to transfer the glued label from the palette and to press the label onto the object or article concerned. The invention also relates to a glue transfer part intended for coaction with one such palette.

Devices of the aforedescribed kind are used, among other things, to apply labels to bottles in breweries, softdrink bottling plants and like plants, which require the labelling devices to operate at high speed. The majority of these devices include a rubber gluing roller, aluminium gluing palettes and an adjustable glue scraper which is operative in determining the thickness of the glue on the gluing roller.

These known devices must be produced with extreme accuracy and any subsequent adjustments to the devices in operation must be effected very precisely, since, for instance, the gluing palettes may only partially penetrate the glue layer on the gluing roller without making contact with the outer surface of the roller itself, since such contact would force the glue layer carried by the roller out onto the edges of the palette. This would cause glue to splash or squirt onto the palette surroundings, and would also result in glue fastening to the front side of the labels, causing the labels to be drawn-off the bottles. Loose labels which fasten to the gluing roller are difficult to remove and may result in damage to the roller, particularly when using foil labels, since such labels can cause wear on the roller when fastening between the glue scraper and the roller. A certain amount of wear can also be caused when the operator scrapes away labels that have fastened to the gluing roller with the aid of a sharp tool.

These and other problems are solved by means of the invention described in my Swedish Patent Application No. 9103026-2. According to this invention, there is used a modified form of gluing roller which permits the palettes to make contact with the outer surface of the roller, therewith avoiding the necessity of extremely narrow tolerances required by the known devices, with which the palette may only partially penetrate the actual glue layer itself without contact with the roller surface. To this end, the outer cylindrical surface of the gluing roller is provided with grooves that are filled with glue. Consequently, even if the gluing palettes make physical contact with the surface of the roller, they will not force-out glue which is liable to penetrate onto the side edges of the palettes. In order to ensure that the palettes will come into contact with the glue present in the grooves, at least the surface layers of the palettes which coact with the gluing roller are made of a slightly elastic or resilient material which will enable parts of said outer layer to be pressed into the grooves. The ridges that extend between the grooves in the gluing roller, are kept clean from glue with the aid of a glue-scraper coacting with said ridges.

Gluing palettes are normally made of aluminium, which is molded to the desired shape, and comprise a mount and a glue-transfer surface connecting with the mount. The shape or configuration of the glue-transfer surface shall correspond to the label to be coated with glue, which requires the aluminium palette to be machined or otherwise worked. The glue-transfer surface shall be slightly cupped in one direction, similar to a part of the cylindrical surface of a cylinder, so as to be able to roll on the rubber surface of the rotating gluing roller, and must therefore be machined to precise tolerances.

With the intention of reducing wear on the rubber surface of the gluing roller, among other things when using metal foil labels, there have earlier been used planar steel rollers and rubber pads which have been firmly vulcanized to the aluminium palettes. These rubber-covered palettes, however, have not been intended to make contact with the smooth roller surface, or cannot be permitted to make such contact, but have solely been permitted to partially penetrate the glue layer on the outer surface of the roller, and consequently this arrangement has the drawbacks described in the aforegoing.

Naturally, such known gluing palettes could be used in the machine described in my aforementioned patent application. However, these palettes are relatively expensive to produce, and the use of aluminium palettes of known construction also results in other drawbacks. For instance, aluminium palettes are relatively sensitive to knocks and blows and other careless handling when washing and cleaning the palettes. When the fit between fingers in the label magazine or the label-transfer device and corresponding recesses in the palette is incorrect, the fingers and/or the palette are likely to be seriously damaged upon contact between the fingers and the hard aluminium palette. When such a palette is damaged, it is normally necessary to replace the entire palette, which is expensive. The replacement of damaged fingers is also expensive. Some known palettes are also firmly mounted on associated shafts, which means that larger and heavier units must be handled and replaced respectively. Furthermore, the curvature of the cylindrical surfaces of the palettes must be adapted precisely to the particular machine with which they shall be used and, consequently, the same palettes cannot be used as spares for machines which originate from different manufacturers, since the palette curvature may be different with different machines.

A prime object of the present invention is to provide a gluing palette with which the aforesaid drawbacks are eliminated, or at least greatly reduced, among other things.

SUMMARY OF THE INVENTION

The invention is based on the realization that this object can be achieved by instead of giving the glue-transfer surface of the palette the form of a part of a supporting aluminium palette and coating this part with a resilient material, the surface can be constructed in the form of an outwardly projecting, resilient part of a plate which can be fitted detachably to a rigid support surface.

According to the present invention, a gluing palette of the kind defined in the first paragraph of this document is particularly characterized in that it includes a core and a carrier in the form of a readily detachable, pliable apron-like element which extends around at least part of the core circumference and which will mould itself to the shape of said core and is provided with at least one outwardly projecting elastic part, the shape of said part corresponding essentially to the shape of the label to which glue shall be applied.

Thus, the core of such a gluing palette need not be shaped in dependence on the application concerned, since the shape of the label need only be reflected in the shape of the elastic outwardly projecting part. Because the flexible plate can be readily exchanged, the palette can be readily adapted for applying glue to desired labels and the glue-transfer surface can be readily replaced in the event of damage. Thus, as spare parts, there need only be stored a number of plates intended for desired labels, and these plates can be manufactured at low cost. The same plates can therewith be used for different machines, since because of their flexibility the plates can be attached to palette cores of slightly different radius of curvature, without creating problems.

In order to enable the flexible plates to be fitted and replaced readily and simply, each of the plates is conveniently constructed in the form of a part of a flexible sleeve which surrounds the palette core. In this regard, the sleeve is intended to be drawn over the palette core from one end of said core and can be fixed correctly in position with the aid of grooves formed in the palette core, or in the inner surface of the sleeve, which coact with projections provided on the opposite part.

The flexible plate may be made of an elastic material, preferably silicone rubber, and the outwardly projecting part may have a surface layer whose degree of elasticity is lower than the elasticity of the remaining material. Preferably, the palette core is comprised of a part of an extruded element, suitably a plastic or aluminium element, and is given a curvature which is adapted to the specific machine concerned. These palette cores need not be replaced when changing to labels of a different configuration, since all that is necessary is to fit another flexible sleeve to the palette cores.

The invention will now be described in more detail with reference to exemplifying embodiments thereof illustrated in the accompanying drawings, in which

DETAILED DESCRIPTION OF THE PREFERRED EMBODIMENTS

Figure 1:
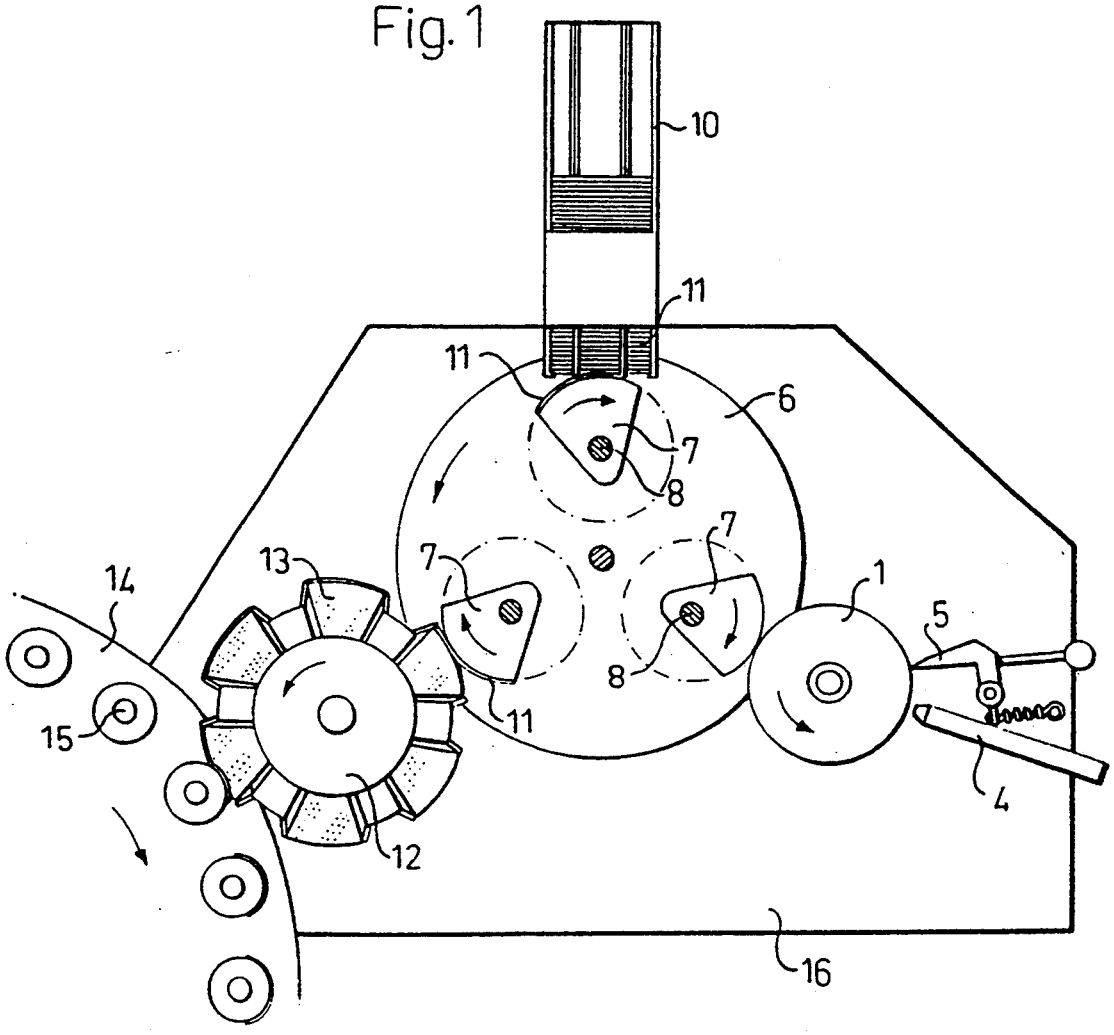
FIG. 1 is a top view of an inventive labelling machine.
Figure 2:
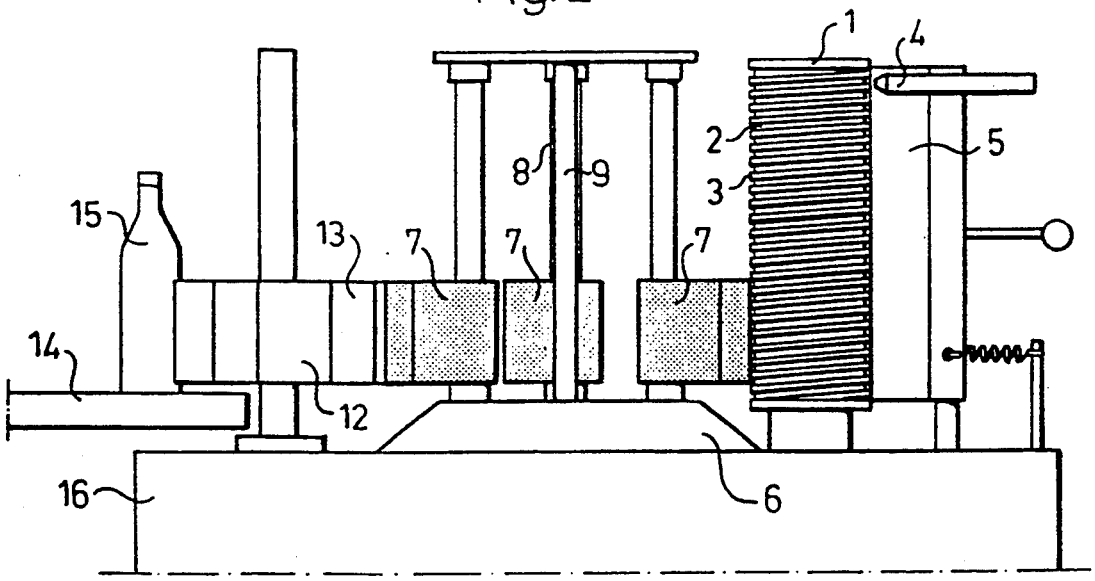
FIG. 2 is a side view of the machine shown in FIG. 1.

FIGS. 1 and 2 illustrate a vertically orientated, rotatable gluing roller 1 whose cylindrical outer surface, or mantle surface, is made of a hard material and is provided with helical grooves 2 which are mutually separated by ridges 3, conveniently planar ridges. The grooves are kept filled with glue, which is delivered to them through an upper nozzle 4 and distributed within the grooves and scraped from the ridges 3 with the aid of a vertically oriented glue scraper 5, which resiliently abuts the ridges 3 separating the grooves 2 in the mantle surface of the roller 1, so as to keep the ridges free from glue.

Also shown in FIGS. 1 and 2 is a carousel 6 which, in the illustrated embodiment, is provided with three gluing palettes 7, each of which is rotatable about an associated rotary shaft 8. The carousel 6 as a whole rotates about a centre shaft 9.

The reference numeral 10 identifies a magazine for labels 11, and the reference numeral 12 identifies a rotary gripping cylinder provided with foam-rubber pads 13 and label-gripping devices. The reference numeral 14 identifies a carousel for bottles 15 to be labelled with labels taken from the magazine 10. The entire machine is shown supported on a stand structure 16, which includes a gearbox having appropriate output shafts for effecting the various rotational movements of the active components.

When the aforedescribed arrangement is in operation, each gluing palette 7 will pivot in relation to the gluing roller 1, in a conventional manner as the carousel 6 rotates, so that a layer of glue is applied to respective palettes 7 as they pass the roller. The palette then performs a corresponding movement as it passes the label magazine 10, wherein the first of the labels 11 in the magazine 10, in which the rear sides of the labels face forwards, fastens temporarily to the palette 7. When the label arrives at the gripping cylinder 12, during rotation of the carousel 6, the gripping devices in coaction with a foam-rubber pad 13 take the label from the palette 7 and, as the cylinder 12 rotates, press the glue-coated surface of the label against the appropriate bottle 15 on the bottle carousel 14, in a conventional manner. Transfer of the label from the palette 7 to the gripping cylinder 12 and pressing of the label onto the bottle 15 may also take place in a conventional manner.

The gluing roller 1 of the described arrangement is provided with grooves 2 which, among other things, allow the gluing palette 7 to make contact with the roller and to perform a rolling motion in relation to said roller without glue being pressed out onto the edges of the palettes, since the glue scraper 5 can lie lightly against the ridges 3 between the grooves 2 and therewith keep the ridges 3 free from glue. This greatly reduces the necessary manufacturing and adjustment tolerances, therewith, among other things, reducing manufacturing costs and operating costs and also providing a much more reliable arrangement, besides ensuring a good result.

In order to ensure that the gluing palettes 7 become coated with glue upon contact with the roller 1, the palettes are provided with an elastic outer layer which when pressed against the roller will penetrate partially into the glue-filled grooves thereon.

It is preferred that the grooves 2 on the roller 1 have the form of helical grooves, meaning, among other things, that a label or some other object which has fastened to the roller will automatically be "screwed" down along the roller in coaction with the scraper 5. The roller is thus self-cleaning, which is to great advantage. Scrap and surplus glue can be collected at the lower end of the roller.

In order to avoid the ridges 3 between the grooves 2 of the gluing roller 1 from becoming coated with glue, the gluing palettes 7 will preferably coact with essentially the same surface of the gluing roller on each rolling occasion. However, in order to avoid uneven wear on the surface layer of the gluing palettes, it is preferred that the rolling surface is displaced slightly between each successive contact of a gluing palette with the roller. To this end, the speed at which the gluing roller rotates is adapted in relation to the working cycle of the gluing palettes, so that the roller will not rotate through a complete revolution or several complete revolutions between each rolling movement of a palette. It is necessary, however, for the peripheral speeds of the roller and the palette to essentially coincide.

The rotational speed of the gluing roller 1 and the pitch of the glue-grooves 2 are suitably selected so that the ridge-surfaces 3 which come into contact with respective gluing palettes 7 are displaced slightly downwards on the palette between successive contacts therewith. This displacement may be in the order of some hundredths of a millimeter between each contact occasion.

The grooves 2 provided in the gluing roller may be relatively shallow, in the order of some tenths of a millimeter, depending on the desired thickness of the glue layer and also on the quality of the glue used. The grooves may have a width of some millimeters, depending on the size of the label surface that needs to be coated with glue. By allowing the pitch of the grooves to vary along the roller, it is possible to vary the quantity of glue applied between different parts of a label or between different labels located at different heights on the object to be labelled. In addition to helical grooves, horizontal, circumferential grooves may also be used, wherein the pitch or division between these grooves 2 can be varied as desired.

Figure 3:
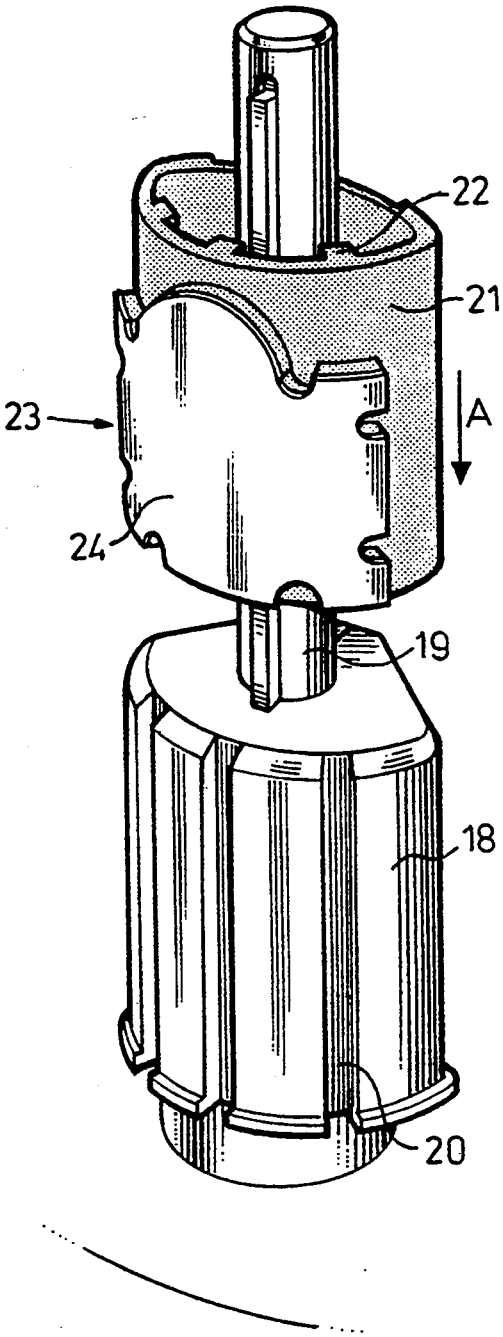
FIG. 3 illustrates the construction of one embodiment of an inventive gluing palette.
Figure 4:
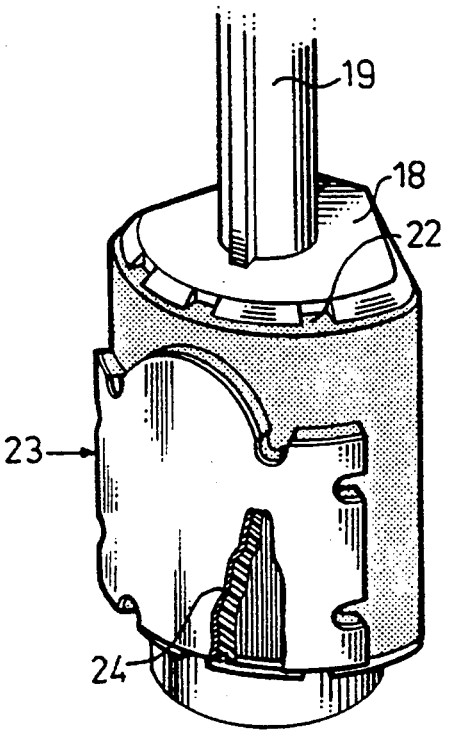
FIG. 4 illustrates the gluing palette of FIG. 3 when assembled.

FIGS. 3 and 4 illustrate an exemplifying embodiment of an inventive gluing palette intended to form part of the aforedescribed arrangement, said palettes being shown in more detail. The illustrated palette comprises a core 18 which may be comprised of a part of an extruded plastic or aluminium body. The core has a curved mantle surface whose radius of curvature is adapted to the machine concerned. The core is affixed to a shaft 19 by means of a key-way and the shaft is intended to be fitted to the carousel 6. In the case of the illustrated embodiment, the mantle surface of the core 18 is provided with longitudinally extending grooves 20 by means of which a flexible or pliable sleeve 21 can be pre-fitted in a precisely determined position in relation to the core 18, by drawing the sleeve down over the core in the direction of arrow A. The inner surface of the sleeve is provided with ridges 22 which coact with the grooves 20 in a manner to lock the sleeve to the core. These ridges also prevent the front surface of the sleeve from stretching; all stretch in the sleeve takes place essentially in the rear part thereof.

The flexible sleeve 21 is made of a relatively elastic material, such as silicone rubber having a hardness of 40–50 Shore A. A rubber sleeve of this kind will readily conform or mould itself to the shape of the mantle surface of the core 18, and hence one and the same rubber sleeve can be used for cores of slightly different curvature and adapted for different machines. The rearward part of the sleeve 21 is preferably thinner than the forward part thereof, so as to concentrate stretching of the sleeve to the rear part of the sleeve.

The sleeve 21 has an outwardly projecting part 23 whose shape corresponds to the shape of the label for which the palette is intended. The outwardly projecting part 23 thus replaces the earlier aluminium palettes molded to desired shapes, the surfaces of which palettes may possibly have a rubber layer vulcanized thereon. Recesses or apertures in the edges of the outwardly projecting part 23 correspond to similar recesses or apertures in earlier aluminium palettes and are intended to receive fingers provided in the label magazine and on the gripping cylinder respectively.

FIG. 4 illustrates the assembled palette, subsequent to drawing the rubber sleeve 21 down over the core 18. The outwardly projecting part 23, which corresponds in form to the label to be applied, will therewith have the desired radius of curvature. Because of the elasticity of the sleeve 21, the sleeve may be affixed to the core 18 even without the provision of mutually coacting grooves and ridges. Alternatively, other fixating means may also be used, of course.

Because the sleeve 21 and the outwardly projecting part 23 are made of an elastic material, small abrupt throws made by the palette as the machine operates, for instance throws caused by faulty journals, can be accepted since such abrupt movements can be taken-up by compression of the elastic material upon contact with the gluing roller. This applies particularly when a relatively elastic material is used. It may therefore be suitable to form a surface layer 24 on the outwardly projecting part of a somewhat harder material, so that this part will not penetrate the grooves in the gluing roller to an unnecessary depth and therewith force glue from the grooves. This somewhat harder surface layer, although still elastic, may, for instance, have a thickness of 2 mm, wherein the remainder of the sleeve may be made of a material which is more elastic than said surface layer.

A gluing palette constructed in accordance with the aforegoing affords several advantages. Among other things, only the cores 18 need be manufactured especially for particular machines, since one and the same elastic sleeve 21 can be used on cores of slightly differing configurations. Should the outwardly projecting part which is intended to make contact with the labels become damaged, it is only necessary to replace the sleeve, which can be done very simply and quickly. The cost of spare sleeves is also very low, since they can be easily mass-produced. Furthermore, a single rubber sleeve 21 may be provided with several superposed outwardly projecting parts for gluing several labels simultaneously, these labels being intended to be stuck at different levels on an object. The palettes are also less sensitive than the earlier used aluminium palettes and are easy to clean. Rubber palettes of the aforedescribed kind can thus also be used advantageously with earlier known machines equipped with smooth gluing rollers. Similar to earlier known aluminium palettes, the rubber palettes can be adapted to different label magazines and also to the configuration of the gripping devices of the gripping cylinder.

It will be understood that the aforedescribed embodiment of an inventive gluing palette can be varied in several respects. For example, the core 18 may be given any desired configuration, since its only requirement is to provide a support for the outwardly projecting part of the elastic sleeve. Although the use of an elastic sleeve will afford important advantages, it is also conceivable to use a flexible sleeve which will conform or mould itself to the configuration of the core and which is provided with an elastic, outwardly projecting part. Instead of a sleeve 21, there may be used an elastic apron-like element which is provided with an outwardly projecting, elastic part and which will embrace the core at least partially, provided that said apron-like part can be fixed to the core in a manner which will enable it part to be readily replaced and stay securely on the core. This apron-like part may be affixed to the core, for instance, with the aid of one or more elastic bands, or tightenable bands which encircle the core.

Alternatively, the flexible apron-like part may be dimensioned so that it will embrace the core around its full circumference so that it can be fixed on the rear side of the core with the aid of fastener hooks.

I claim:

1. A gluing palette for use with machines for gluing labels to objects such as bottles, said palette coacting with a rotating gluing roller (1) so as to be coated with glue and then to transfer glue to a label (11) transported by the palette (7) from a label magazine (10) to a transfer device (12) to take the glue-coated label from the palette and to press the label against the object (15), wherein:

a) the palette comprises a core (18), and a carrier in the form of a readily detachable, pliable, apron element (21) made of an elastic material, and adapted to extend around at least part of the core circumference and mould itself to a configuration of said core, and b) said apron element has at least one outwardly projecting part (23) made of an elastic material and having a shape which corresponds essentially to the shape of the label (11) to be coated with glue, and further comprising:

c) means for fixing the apron element in a correct, intended position on the core, and for preventing any lateral stretching of a portion of the apron element relative to the core, said fixing and preventing means comprising projections formed on one of an inner surface of the apron element and the core, and cooperable with recesses formed on another one of the core and the inner surface of the apron element, said fixing and preventing means being disposed at least at the location of the outwardly projecting part.

2. A gluing palette according to claim 1, wherein the apron element forms part of a flexible sleeve (21) which embraces the core (18).

3. A gluing palette according to claim 2, wherein the sleeve (21) is intended to be drawn over the core (18) from one end thereof; and the recesses comprise grooves (20).

4. A gluing palette according to claim 1, wherein the apron element (21) is provided with means for coaction with fastener means on the rear side of the core (18).

5. A gluing palette according to claim 1, wherein the apron element is made of silicone rubber.

6. A gluing palette according to claim 5, wherein the outwardly projecting part (23) of the elastic material has a surface layer (24) whose elasticity is lower than the elasticity of the remainder of the material.

7. A gluing palette according to claim 1, wherein the outwardly projecting part (23) is provided with recesses for accommodating fingers in the label magazine (10) and in the transfer device (12).

8. A gluing palette according to claim 1, wherein the core (18) is comprised of part of an extruded body.

9. A glue-transfer part of a gluing palette for use in machines for gluing labels to objects such as bottles, said palette (7) coacting with a rotary gluing roller (1) so as to be coated with glue and thereafter to transfer glue to a label (11) carried by the palette from a label magazine (10) to a transfer device (12) to take the glue-coated label from the palette and press the label against the object (15), wherein said glue transfer part comprises a flexible sleeve (21) made of an elastic material and configured to embrace a palette core (18); the sleeve having an outwardly projecting part (23) made of an elastic material and having a shape which corresponds essentially to the shape of the label (11) to be coated with glue, and further comprising means for fixing the sleeve in a correct, intended position on the core, and for preventing any lateral stretching of a portion of the sleeve relative to the core, said fixing and preventing means comprising projections formed on one of an inner surface of the sleeve and the core, and cooperable with recesses formed on another one of the core and the inner surface of the sleeve, said fixing and preventing means being disposed at least at the location of the outwardly projecting part.

10. A glue transfer part according to claim 9, wherein the outwardly projecting part (23) has a surface layer (24) whose elasticity is lower than the elasticity of the remainder of the sleeve material.

* * * * *